US008926031B2

(12) United States Patent
Belton

(10) Patent No.: US 8,926,031 B2
(45) Date of Patent: Jan. 6, 2015

(54) UNDER CABINET DRAWER ASSEMBLY

(71) Applicant: Eric Scott Belton, Baxter, MN (US)

(72) Inventor: Eric Scott Belton, Baxter, MN (US)

( * ) Notice: Subject to any disclaimer, the term of this patent is extended or adjusted under 35 U.S.C. 154(b) by 0 days.

(21) Appl. No.: 13/944,671

(22) Filed: Jul. 17, 2013

(65) Prior Publication Data

US 2014/0021844 A1 Jan. 23, 2014

Related U.S. Application Data

(60) Provisional application No. 61/672,367, filed on Jul. 17, 2012.

(51) Int. Cl.
*A47B 88/04* (2006.01)
*A47B 88/08* (2006.01)

(52) U.S. Cl.
CPC ..... *A47B 88/04* (2013.01); *A47B 88/0407* (2013.01); *A47B 88/0455* (2013.01); *A47B 88/08* (2013.01); *A47B 2210/0059* (2013.01)
USPC ..... 312/246; 312/334.7

(58) Field of Classification Search
CPC ..... A47B 88/04; A47B 88/0407; A47B 88/0455; A47B 88/0466; A47B 88/10; A47B 88/14; A47B 88/12; A47B 88/0451; A47B 88/06; A47B 2210/0037; A47B 2210/007; A47B 2210/16; A47B 2210/0059; A47B 2210/0043; B60N 3/083
USPC ..... 312/334.12, 334.41, 350, 349, 246, 312/247, 323, 404, 402, 334.19, 334.18, 312/334.7, 334.26, 330.1; 384/21; 296/37.9
See application file for complete search history.

(56) References Cited

U.S. PATENT DOCUMENTS

| | | | | | |
|---|---|---|---|---|---|
| 1,056,166 | A * | 3/1913 | Gillespie | 312/123 |
| 2,839,349 | A * | 6/1958 | Culver | 312/323 |
| 3,031,249 | A * | 4/1962 | Koch | 312/334.12 |
| 3,078,130 | A * | 2/1963 | Beeck | 384/19 |
| 3,351,404 | A * | 11/1967 | Blake | 312/246 |
| 3,460,876 | A * | 8/1969 | De Boer | 312/246 |
| 3,489,478 | A * | 1/1970 | Beurkens | 312/246 |
| 3,586,394 | A * | 6/1971 | Hecksel | 384/23 |
| 3,694,048 | A * | 9/1972 | Middleton | 312/246 |
| 3,722,975 | A * | 3/1973 | Taylor | 312/334.44 |
| 4,121,876 | A * | 10/1978 | Ratti | 384/19 |
| 4,266,836 | A * | 5/1981 | Sato | 312/246 |
| 4,792,195 | A * | 12/1988 | Adriaansen et al. | 312/245 |
| 6,050,628 | A * | 4/2000 | Allison et al. | 296/37.12 |
| 6,478,393 | B2 * | 11/2002 | Kim et al. | 312/334.12 |
| 7,140,703 | B1 * | 11/2006 | Holdgate et al. | 312/323 |
| 7,178,889 | B2 * | 2/2007 | Hoshide et al. | 312/334.7 |
| 7,249,814 | B2 * | 7/2007 | Hoshide et al. | 312/334.7 |
| 8,408,666 | B2 * | 4/2013 | Armstrong et al. | 312/408 |
| 8,517,482 | B2 * | 8/2013 | Carey | 312/334.7 |
| 2003/0042830 | A1 * | 3/2003 | Gregorio | 312/325 |
| 2007/0241652 | A1 * | 10/2007 | Hoshide et al. | 312/334.7 |
| 2011/0219808 | A1 * | 9/2011 | Oh | 62/465 |
| 2012/0074825 | A1 * | 3/2012 | Armstrong et al. | 312/334.23 |

(Continued)

*Primary Examiner* — Janet M Wilkens

(74) *Attorney, Agent, or Firm* — Geiser Law, PLLC; Greg N. Geiser

(57) ABSTRACT

A drawer assembly for constructing and mounting a drawer underneath a cabinet upper. The assembly comprising a top bracket and a drawer side mount. The top bracket and the side mount having an arcuate edge in communication, wherein the drawer side mount slidably moves in an arc downward and outward relative to the top bracket when mounted on an upper cabinet.

2 Claims, 5 Drawing Sheets

(56) References Cited

U.S. PATENT DOCUMENTS

2012/0146473 A1* 6/2012 Carey ..... 312/334.1
2012/0224796 A1* 9/2012 Carey et al. ..... 384/21
2013/0212949 A1* 8/2013 Doll ..... 49/414
2013/0313954 A1* 11/2013 Koelling et al. ..... 312/319.1

* cited by examiner 301
101
103
210
201
203
210

UNDER CABINET DRAWER ASSEMBLY

CROSS REFERENCE TO RELATED APPLICATIONS

This application claims the benefit of provisional patent application Ser. No. 61/672,367, filed 2012 Jul. 17 by the present inventor.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The present invention relates to a drawer assembly for installation underneath in an overhead cabinet or space and more particularly a drawer assembly that displays the contents of the drawer as the drawer is opened.

Space in the kitchen is always at a premium given the amount of utensils, electronics, containers, foods, flatware, dishes, and other items that are stored on the countertops or within the kitchen cabinets. One way to clear counter space is to utilize the space underneath the upper cabinets often found in kitchens.

Current drawers mounted on the underside of the upper cabinets typically use a horizontal slide culminating in a downward angle, wherein the drawer pulls out horizontally for a majority of its outward traverse and tips downward revealing the contents of the drawer. This configuration, although useful, does have several disadvantages. The first disadvantage is that the configuration of the slide requires the user to lift the drawer back onto the horizontal portion so it can be closed. Secondly, in the open position the entire weight of the drawer is resting on a trailing edge of the drawer. Therefore, the weight of the drawer must be restricted so as to not cause a failure of the mounting bracket.

Further, drawer assemblies according to the prior art, lack smooth travel and only display the contents of the drawer at the culmination of the traverse of the drawer. Therefore, there is a need for a under cabinet drawer and mount that has a smooth traverse the entire length of its travel, that displays the contents of the drawer throughout its length of travel, is easily pulled in and out regardless of its position within its traverse, and is mounted such that the weight of the drawer is supported evenly allowing the drawer to store heavier contents.

SUMMARY OF THE INVENTION

The present invention provides a drawer assembly for mounting underneath an upper cabinet. In the preferred embodiment, the drawer assembly includes a pair of a mated top bracket and a drawer side mount, the pair being a mirror image of each other, and a mating member slidably securing the top bracket and the drawer side mount together. The top bracket is mounted to the underside or front facing of the top cabinet in a fixed position and includes a top edge, bottom edge, front side, and rear side. The bottom edge having an arcuate concave shape with the apex of the arc centrally positioned along the length of the top bracket and having a lip. The lip sized for engagement within a top channel of the mating member.

The drawer side mount is fixed to a pre-assembled drawer and slidably movable relative to the top bracket and includes a second top edge, a second bottom edge, a second front side, and second rear side. The second top edge having a convex arcuate shape corresponding to the shape of the bottom edge and a lip. The lip sized for engagement within a bottom channel of the mating member. The drawer side mount being slidably received within the bottom channel of the mating member along the bottom edge of the top bracket with the apex of the arc centrally positioned along the length of the drawer side mount. The arcuate shape of the assembly provides frictional resistance as the drawer is pulled out and provides a view of the contents of the drawer as the shape of the arc allows the drawer to move outward and downward along a smooth curve.

The mating member includes the top channel and the bottom channel, the top channel having an arcuate shape corresponding to the shape of the bottom edge of the top bracket, wherein the mating member smoothly slides along the arcuate shape of the bottom edge. The bottom channel having an arcuate shape corresponding to the shape of the second top edge of the drawer side mount, wherein the second top edge of the drawer side mount smoothly slides along the arcuate shape of the bottom channel.

Although the inclusion of a mating member is preferred for its ability to allow for a further extension of the drawer when it is pulled out, the mating member isn't necessary for the operation of the present invention. Without a mating member, the second top edge of the drawer side mount and the bottom edge of the top bracket are in slidable communication wherein the drawer side mount will slide outward and downward along the arcuate curve of the top bracket bottom edge and the drawer side mount top edge. In this configuration, the top bracket may include a channel to slidably receive the top edge of the drawer side mount. This configuration may use other materials within the channel or mounted to the top edge of the side mount to allow for easy manipulation of the drawer. These materials may include, metal, Teflon coatings, bearings, plastic, or other similar like materials that may reduce friction and allow the draw to slide easily relative to the top bracket.

Although, an assembly is preferred, it is understood that the present invention could include a drawer and drawer mount utilizing the same arcuate slide as the assembly. The assembly is preferred as it can be modified and fit to drawers of all sizes for mounting on cabinets of all sizes, wherein a user can purchase the assembly and affix the assembly to a custom constructed drawer.

In the preferred embodiment of the present invention, the top bracket and drawer side mount are constructed out of metal and sold as a kit to allow a user to construct a drawer of varying widths allowing for customization of the under cabinets. This kit will include the pair of side mounts and the pair of top brackets. The user will then construct a drawer using the side mounts as the drawer sides and supplying cut wood that is then affixed to the drawer sides at the desired width. The side mounts may include mounting brackets on their front side and rear side to aide in the construction of the drawer. Preferably, the depth of the drawers is fixed by the length of the side mount. Accordingly this depth is between 10 to 34 inches to accommodate the standard depth of most cabinet uppers.

Preferably, the arc of the top bracket and the drawer side mount is an arc from a circle having a diameter of forty-eight inches. This arc is preferred as provides stability and provides the user with a view of the contents of the drawer as the drawer is pulled out.

In an alternate embodiment of the present invention, the mating member is mounted exterior to the top bracket and the side mount. In this configuration the mating member maintains an arcuate shape similar to the top bracket and the side mount and provides a grasping force to secure the top bracket and the side mount during slidable communication. The benefits of an exterior mounting are to provide additional support for the drawer assembly and to create more space at the drawer interior.

In a further alternate embodiment of the present invention the mated top bracket and drawer side mount include a plurality of wheels arranged in an identical arcuate pattern. The mating member having an arcuate shape corresponding to the arcuate shape of the plurality of wheels on the mated top bracket and drawer side mount and having an internal groove and an external groove. The external groove receiving the wheels of the mated top bracket and the internal groove receiving the wheels of the drawer side mount. According to this configuration, the mating member will extend along the wheels of the top bracket and the drawer side mount will extend along the length of internal groove of the mating member.

BRIEF DESCRIPTION OF THE SEVERAL VIEWS OF THE DRAWING(S)

The accompanying drawings are included to provide a further understanding of the present invention and are incorporated in and constitute a part of this specification. The drawings illustrate exemplary embodiments of the present invention and together with the description serve to further explain the principles of the invention. Other aspects of the invention and the advantages of the invention will be better appreciated as they become better understood by reference to the Detailed Description when considered in conjunction with accompanying drawings, and wherein.

DETAILED DESCRIPTION OF THE INVENTION

Figure 1:
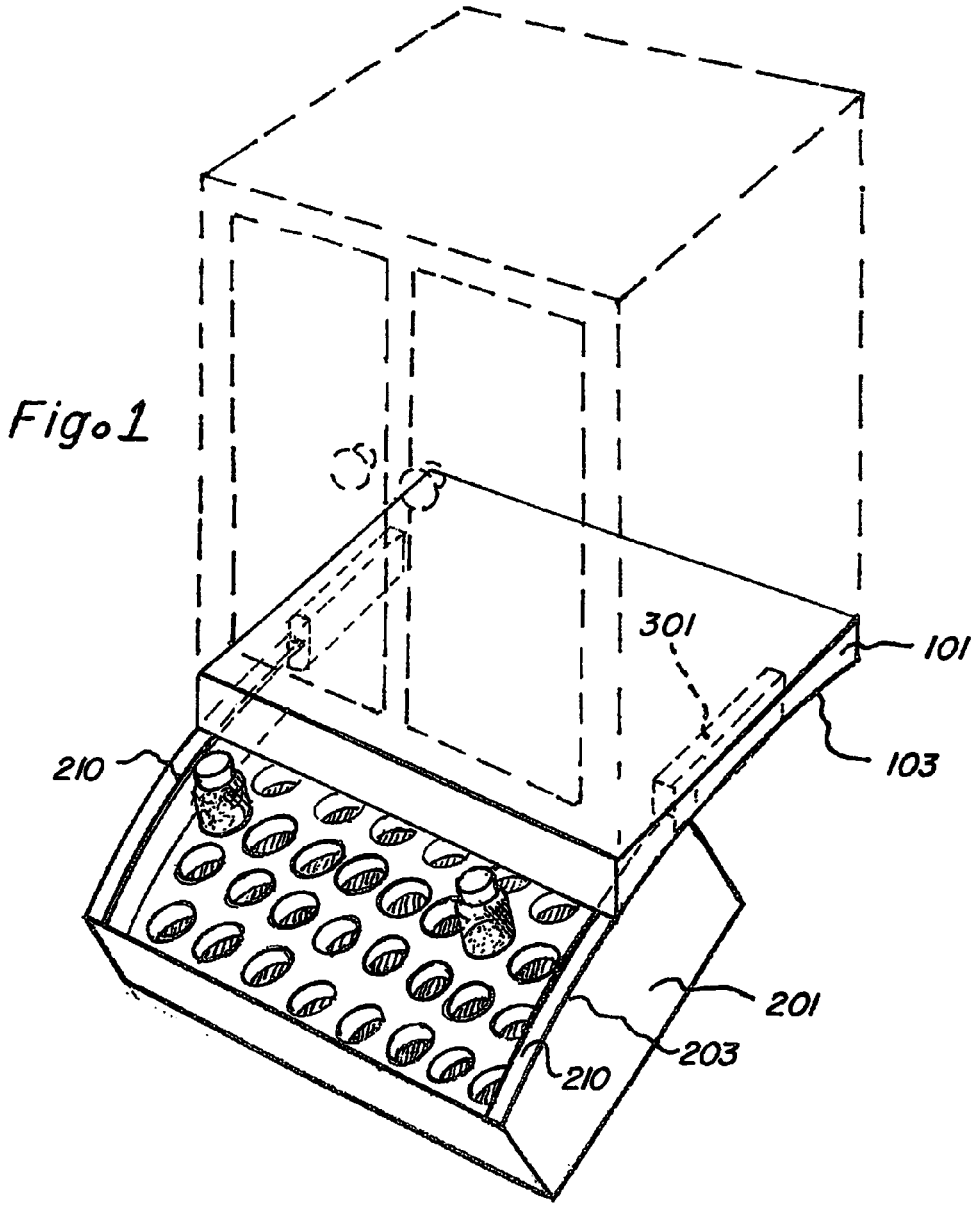
FIG. 1 is a perspective view of the device mounted to a cabinet, according to the present invention.
Figure 2:
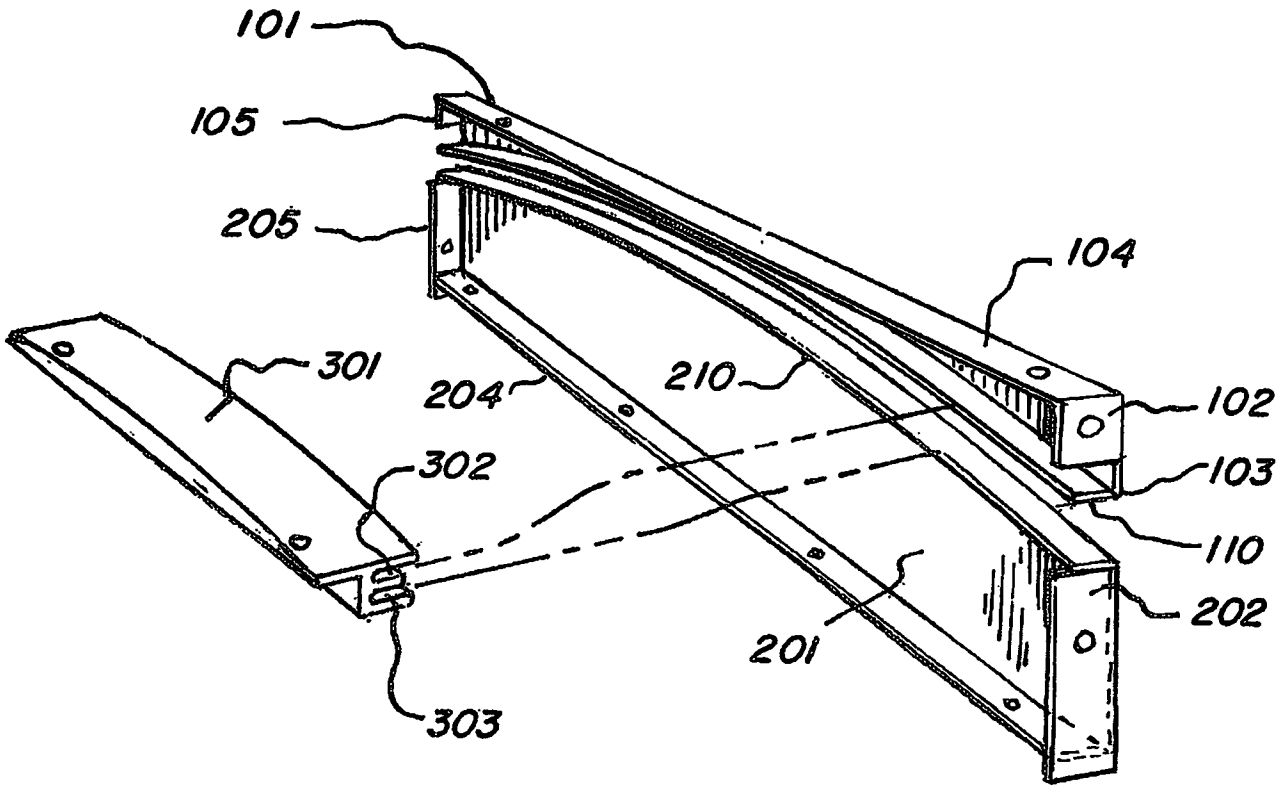
FIG. 2 is a perspective assembly view of the device, according present invention.

Referring now to FIGS. 1-2 of the present invention, the drawer assembly includes a pair of a mated top bracket 101 and a drawer side mount 201, the pair being a mirror image of each other, and a mating member 301 slidably securing the top bracket 101 and the drawer side mount 201 together. The top bracket 101 is mounted to the underside or front facing of the top cabinet in a fixed position and includes a top edge 104, bottom edge 103, front side 102, and rear side 105. The bottom edge 103 having an arcuate concave shape with the apex of the arc centrally positioned along the length of the top bracket and having a lip 110. The lip 110 sized for engagement within a top channel 302 of the mating member 301.

The drawer side mount 201 is fixed to a pre-assembled drawer and slidably movable relative to the top bracket and includes a second top edge 203, a second bottom edge 204, a second front side 202, and second rear side 205. The second top edge 203 having a convex arcuate shape corresponding to the shape of the bottom edge 103 and having a lip 210. The lip 210 sized for engagement within a bottom channel 303 of the mating member 301. The drawer side mount 201 being slidably received within the bottom channel 303 of the mating member 301 along the bottom edge 103 of the top bracket 101 with the apex of the arc centrally positioned along the length of the drawer side mount 201. The arcuate shape of the assembly provides frictional resistance as the drawer is pulled out and provides a view of the contents of the drawer as the shape of the arc allows the drawer to move outward and downward along a smooth curve.

The mating member 301 includes the top channel 302 and the bottom channel 303, the top channel 302 having an arcuate shape corresponding to the shape of the bottom edge 103 of the top bracket 101, wherein the mating member 301 smoothly slides along the arcuate shape of the bottom edge 103. The bottom channel 303 having an arcuate shape corresponding to the shape of the second top edge 203 of the drawer side mount 2301, wherein the second top edge 203 of the drawer side mount smoothly slides along the arcuate shape of the bottom channel 303.

Although the inclusion of a mating member 301 is preferred for its ability to allow for a further extension of the drawer when it is pulled out, the mating member isn't necessary for the operation of the present invention. Without a mating member 301, the second top edge 203 of the drawer side mount 201 and the bottom edge 103 of the top bracket 101 are in slidable communication wherein the drawer side mount 201 will slide outward and downward along the arcuate curve of the top bracket bottom edge 103 and the drawer side mount top edge 203. In this configuration, the top bracket 101 may include a channel to slidably receive the top edge 203 of the drawer side mount 201. This configuration may use other materials within the channel or mounted to the top edge 203 of the side mount to allow for easy manipulation of the drawer. These materials may include, metal, Teflon coatings, bearings, plastic, or other similar like materials that may reduce friction and allow the draw to slide easily relative to the top bracket.

Although, an assembly is preferred, it is understood that the present invention could include a drawer and drawer mount utilizing the same arcuate slide as the assembly. The assembly is preferred as it can be modified and fit to drawers of all sizes for mounting on cabinets of all sizes, wherein a user can purchase the assembly and affix the assembly to a custom constructed drawer.

In the preferred embodiment of the present invention, the top bracket 101 and drawer side mount 201 are constructed out of metal, although other materials may be used, and sold as a kit to allow a user to construct a drawer of varying widths allowing for customization of the under cabinets. This kit will include the pair of side mounts 201 and the pair of top brackets 101. The user will then construct a drawer using the side mounts 201 as the drawer sides and supplying cut wood that is then affixed to the drawer sides at the desired width. The side mounts 201 may include mounting brackets on their front side 202 and rear side 205 to aide in the construction of the drawer. Preferably, the depth of the drawers is fixed by the length of the side mount 201. Accordingly this depth is between 10 to 34 inches to accommodate the standard depth of most cabinet uppers.

Preferably, the arc of the top bracket 101 and the drawer side mount 201 is an arc from a circle having a diameter of forty-eight inches. This arc is preferred as provides stability and provides the user with a view of the contents of the drawer as the drawer is pulled out.

Figure 3:
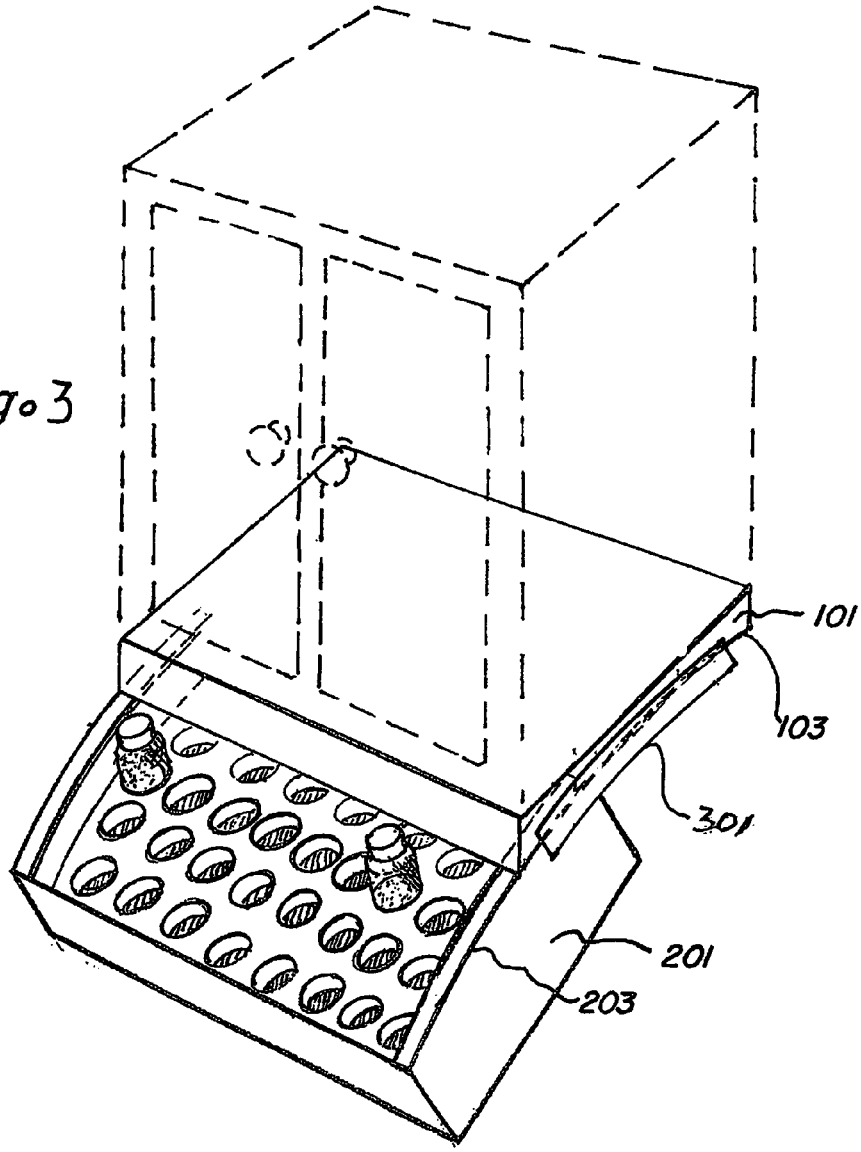
FIG. 3 is a perspective view of an alternate embodiment of the device mounted to a cabinet, according to the present invention.
Figure 4:
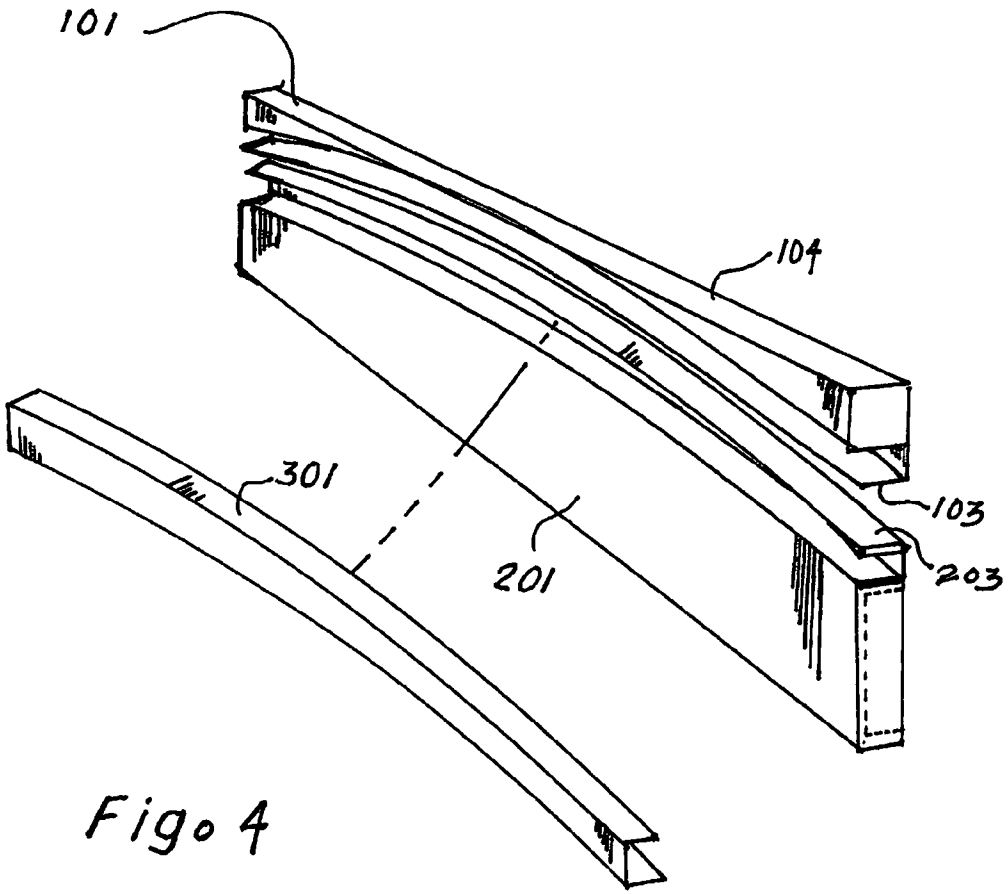
FIG. 4 is a perspective assembly view of an alternate embodiment of the device, according to the present invention.

Referring now to FIGS. 3-4, an alternate embodiment of the present invention, the mating member 301 is mounted exterior to the top bracket 101 and the side mount 201. In this configuration the mating member 301 maintains an arcuate shape similar to the top bracket 101 and the side mount 201 and provides a grasping force to secure the top bracket 101 and the side mount 201 during slidable communication. The benefits of an exterior mounting of the mounting member 301 are to provide additional support for the drawer assembly and to create more space at the drawer interior.

Figure 6:
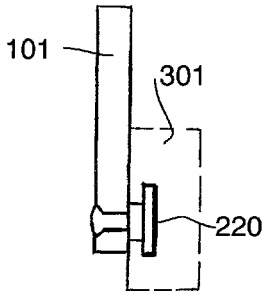
FIG. 6 is an end view of an alternate embodiment of the device along and in the direction of the section line 6-6 as shown in FIG. 5.
Figure 7:
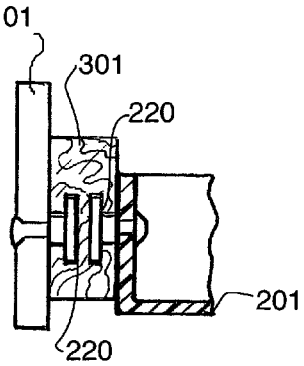
FIG. 7 is an end view of an alternate embodiment of the device along and in the direction of the section line 7-7 as shown in FIG. 5.
Figure 5:
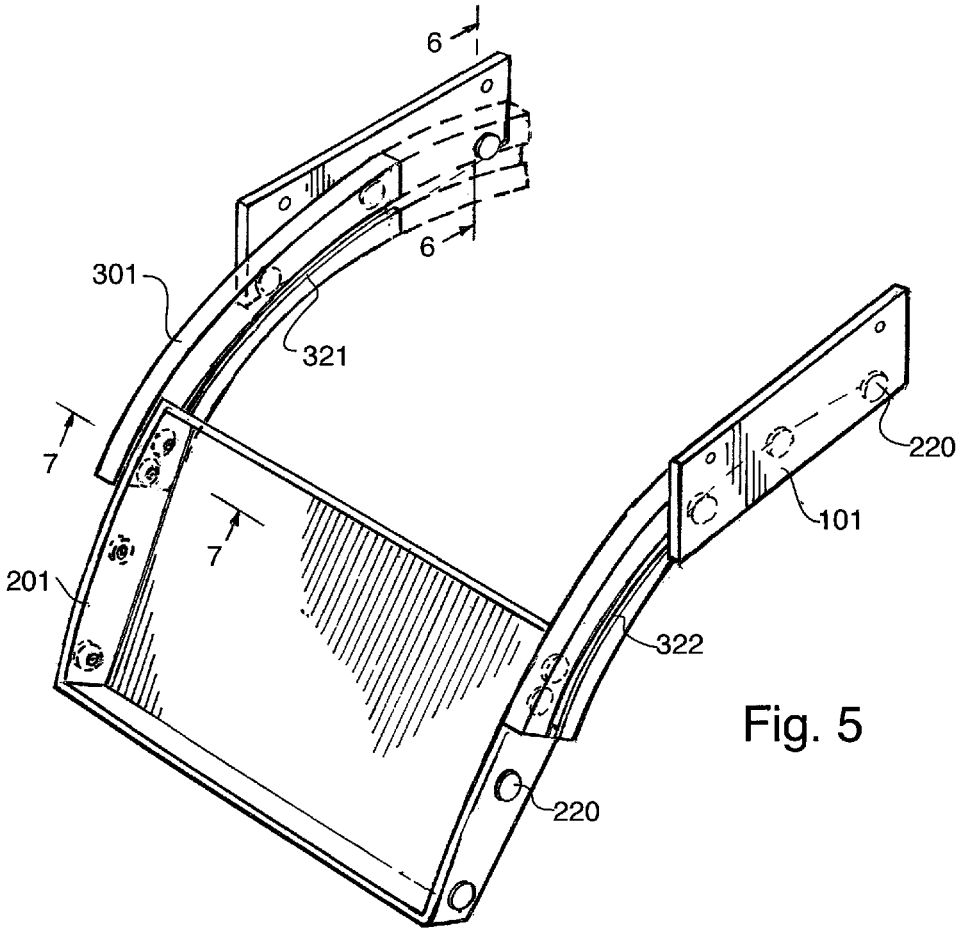
FIG. 5 is perspective exploded view of an alternate embodiment of the device, according to the present invention.

Referring now to FIGS. 5-7, in a further alternate embodiment of the present invention the mated top bracket 101 and drawer side mount 201 include a plurality of wheels 220 arranged in an identical arcuate pattern. The mating member 301 having an arcuate shape corresponding to the arcuate shape of the plurality of wheels 220 on the mated top bracket 101 and drawer side mount 201 and having an internal groove 321 and an external groove 322. The external groove 322 receiving the wheels 220 of the mated top bracket 101 and the internal groove 321 receiving the wheels 220 of the drawer side mount 201. According to this configuration, the mating member 301 will extend along the wheels 220 of the top bracket 101 and the drawer side mount 201 will extend along the length of internal groove 221 of the mating member 301.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) but that the invention will include all embodiments falling with the scope of the appended claims.

The invention claimed is:

1. A drawer slide assembly, the drawer slide assembly extending outward and downward to reveal the contents of a drawer, the drawer slide assembly comprising:

a pair of top brackets, the top brackets each being a mirror image of each other, the top brackets each mounted in an opposed fixed position, the top brackets each having a bottom edge, the bottom edge each having an arcuate concave shape;

a pair of drawer side mounts, the drawer side mounts each being a mirror image of each other, the drawer side mounts each mounted to an opposed side of the drawer, the drawer side mounts each having a top edge, the top edge each having a convex arcuate shape, the convex arcuate shape corresponding to the arcuate shape of each of the top brackets; and a pair of mating members, the mating members mounted to an interior side of the drawer, the mating members each having an arcuate groove corresponding to the shape of the top bracket and the drawer side mounts, wherein each of the pair of side mounts is slidably received within the arcuate groove.

2. A drawer slide assembly, the drawer slide assembly extending outward and downward to reveal the contents of a drawer, the drawer slide assembly comprising:

a mounting member, the mounting member arcuate in shape and having an interior side and an exterior side, the interior and exterior sides each having a groove, the groove extending along a length of the arch and sized to receive a wheel;

a top bracket, the top bracket having at least three wheels, the wheels arranged in an arch, the arch corresponding to the shape of the mounting member, wherein the groove of the exterior side slidably engages the wheels of the top bracket;

a drawer side, the drawer side having at least three wheels, the wheels arranged in an arch, the arch corresponding to the shape of the mounting member, wherein the groove of the interior side slidably engages the wheels of the drawer side.

* * * * *